US006894594B2

(12) United States Patent
Fello et al.

(10) Patent No.: US 6,894,594 B2
(45) Date of Patent: May 17, 2005

(54) CIRCUIT BREAKER INCLUDING A CRADLE AND A PIVOT PIN THEREFOR

(75) Inventors: Joseph P. Fello, Verona, PA (US); Russell T. Borona, Gurabo, PR (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/601,056

(22) Filed: Jun. 20, 2003

(65) Prior Publication Data

US 2004/0257183 A1 Dec. 23, 2004

(51) Int. Cl.[7] ..... H01H 9/00
(52) U.S. Cl. ..... 335/172; 335/35
(58) Field of Search ..... 335/23–25, 35–42, 335/165–176, 6, 16, 202

(56) References Cited

U.S. PATENT DOCUMENTS 3,849,747 A 11/1974 Mrenna et al.
3,950,714 A * 4/1976 Mrenna et al. ..... 335/35
4,933,653 A 6/1990 Mrenna et al.
5,008,645 A 4/1991 Mrenna
5,196,815 A * 3/1993 Chien et al. ..... 335/16
5,302,786 A * 4/1994 Rosen et al. ..... 200/400
5,343,179 A 8/1994 Pipich et al.
5,805,038 A 9/1998 Palmer et al.
6,040,746 A 3/2000 Maloney et al.
6,239,676 B1 5/2001 Maloney et al.
6,259,339 B1 7/2001 Simms et al.
6,469,600 B1 * 10/2002 Seese et al. ..... 335/6
2002/0011908 A1 * 1/2002 Kim et al. ..... 335/35

* cited by examiner

*Primary Examiner*—Lincoln Donovan
(74) *Attorney, Agent, or Firm*—Martin J. Moran

(57) ABSTRACT

A circuit breaker includes a molded housing having a base and a cover forming a recess. A cylindrical steel pivot pin is disposed in the recess of the housing. Fixed and movable separable contacts are disposed within the molded housing. An operating mechanism is disposed within the molded housing for moving the separable contacts between an open position and a closed position. The operating mechanism includes a cradle having a latch portion and a generally U-shaped pivot portion which pivotally engages the cylindrical steel pivot pin. A trip mechanism cooperates with the operating mechanism to trip open the separable contacts. The trip mechanism includes a portion which engages the latch portion of the cradle when the separable contacts are in the closed position.

3 Claims, 5 Drawing Sheets

CIRCUIT BREAKER INCLUDING A CRADLE AND A PIVOT PIN THEREFOR

BACKGROUND OF THE INVENTION

1. Field of the Invention

The present invention relates generally to electrical switching apparatus and, more particularly, to circuit breakers including an operating mechanism having a pivoting cradle.

2. Background Information

Circuit breakers of the type having an operating mechanism and a trip mechanism, such as a thermal trip assembly and/or a magnetic trip assembly, which are automatically releasable to effect trip operations and manually resettable following trip operations are common and generally well known in the art. Examples of such circuit breakers are disclosed in U.S. Pat. Nos. 3,849,747; 4,933,653; and 5,008,645.

Such circuit breakers, commonly referred to as "miniature" circuit breakers, have been in use for many years and their design has been refined to provide an effective, reliable circuit breaker, which can be easily and economically manufactured on a large scale. In addition, circuit breakers of this type may be utilized in conjunction with arc fault and/or ground fault trip mechanisms as well.

Circuit breakers of this type include at least one set of separable contacts disposed within a non-conductive housing. Typically, there is a fixed contact attached to the housing and a movable contact coupled to the operating mechanism. The operating mechanism includes a movable operating handle that extends outside of the housing. The operating mechanism further includes an operating arm, upon which the movable contact is disposed, the trip mechanism, and a cradle. The cradle is coupled to a spring and is pivotally disposed between the trip mechanism and the operating arm. One portion of the cradle pivots with respect to the housing while another portion of the cradle has a latch ledge, which is latched by the trip mechanism.

The operating member or handle has essentially two or three stable positions: (1) ON and OFF; or (2) ON, OFF and TRIPPED. In the latter case, the three positions tell the operator what condition the circuit breaker is operating in when viewed. In normal operation, the handle is maintained in the ON position. Then, once the trip mechanism is automatically released, in order to protect electrical circuitry from damage due to an overcurrent condition, such as an overload or relatively high level short circuit, the handle automatically moves to the TRIPPED position. The circuit breaker must then be reset, as is known in the art, by moving the handle beyond the OFF position to a RESET position from which the handle returns to the OFF position when released. The circuit breaker may then be manually operated from the OFF to the ON position, in order to allow the circuit breaker to resume normal operation. In addition, the handle is manually maneuverable from the ON to the OFF position if it is desired to open the protected circuit.

It is known to employ molded material, such as a molded pivot pin, in miniature residential and industrial circuit breakers as a pivot point for the operating mechanism cradle. See, for example, U.S. Pat. Nos. 6,259,339; 6,239,676; 6,040,746; and 5,805,038.

A thermal-magnetic circuit breaker is calibrated, for example, to maintain a current flow of 100% of its rated current and to trip within predetermined times at 135% and 200% of such rated current. However, whenever the circuit breaker housing is made from a stronger, albeit softer, material, the motion of the cradle wears into the molded pivot pin. Hence, the cradle and, thus, its position with respect to the trip mechanism changes, thereby impacting operation of the circuit breaker. For example, thermal calibration of the bimetal trip assembly will change.

U.S. Pat. No. 5,343,179 discloses a miniaturized solenoid operated trip device including a generally L-shaped pivoting trigger member operated by a solenoid to restrain or release a sliding actuator. The L-shaped trigger member has a pivot hole adjacent the junction of two legs of the L-shape, whereby the trigger member is pivotally mounted on a steel pivot pin mounted in a bottom molded housing part via retaining clasps. The sliding actuator is constrained to move back and forth by a slotted structure of the bottom molded housing part.

Current is switched to the solenoid, for example, when an overcurrent condition, undervoltage or ground fault is detected in the load circuit. When current is applied, a solenoid plunger retracts into the solenoid. This rotates the trigger member around the steel pivot pin, releasing an interlock with a mating hook surface on the sliding actuator. An actuator spring propels the sliding actuator outwardly with a dynamic action such that an abutment of the actuator strikes a paddle on a trip bar of a pivoting contact breaking mechanism. The contact breaking mechanism is operatively associated with a contactor cradle or the like to make or break an electrical circuit.

There is room for improvement in circuit breakers including an operating mechanism.

There is also room for improvement in circuit breaker operating mechanisms including a cradle.

SUMMARY OF THE INVENTION

These needs and others are met by the present invention, which disposes a steel pivot pin in a recess of a molded housing of a circuit breaker. The steel pivot pin forms a pivot point for a cradle of the circuit breaker operating mechanism, thereby allowing the cradle to reliably rotate about the steel pivot pin and function through the operating requirements of the circuit breaker.

As one aspect of the invention, a circuit breaker comprises: a housing including a recess, the housing being made of a first material; a pivot pin disposed in the recess of the housing, the pivot pin being made of a second material, which is substantially harder than the first material; separable contacts disposed within the housing; and an operating mechanism disposed within the housing for moving the separable contacts between an open position and a closed position, the operating mechanism including a cradle having a pivot portion which pivotally engages the pivot pin.

The pivot pin may have a cylindrical shape with a semi-circular portion; and the pivot portion of the cradle may have a general U-shape which engages the semi-circular portion of the cylindrical shape of the pivot pin.

The pivot pin may be made of steel and have a cylindrical shape with a semi-circular portion; and the pivot portion of the cradle may have a general U-shape which engages the semi-circular portion of the cylindrical shape of the pivot pin.

The housing may include a base and a cover attached to the base; the base may include a first arcuate recess; the cover may include a second arcuate recess; the pivot pin may have a cylindrical shape with a first portion and a second portion; one of the first and second arcuate recesses may engage the first portion of the pivot pin; and another one of the first and second arcuate recesses may engage the second portion of the pivot pin.

The housing may further include a base, a cover and a plurality of fasteners attaching the cover to the base; the base may include a first arcuate recess having a first end; the cover may include a second arcuate recess having a second end; the pivot pin may have a cylindrical shape with a first portion and a second portion; one of the first and second arcuate recesses may engage the first portion of the pivot pin; another one of the first and second arcuate recesses may engage the second portion of the pivot pin; and the pivot portion of the cradle may engage the pivot pin between the first and second ends of the first and second arcuate recesses.

As another aspect of the invention, a circuit breaker comprises: a housing including a recess; a steel pivot pin disposed in the recess of the housing; separable contacts disposed within the housing; an operating mechanism disposed within the housing for moving the separable contacts between an open position and a closed position, the operating mechanism including a cradle having a latch portion and a pivot portion which pivotally engages the steel pivot pin; and a trip mechanism cooperating with the operating mechanism to trip open the separable contacts, the trip mechanism including a portion which engages the latch portion of the cradle when the separable contacts are in the closed position.

The housing may be a molded housing made of glass polyester, and the steel pivot pin may be substantially harder than the glass polyester.

The steel pivot pin may have a cylindrical shape with a semi-circular portion; and the pivot portion of the cradle may have a general U-shape which engages the semi-circular portion of the cylindrical shape of the steel pivot pin.

The housing may be a molded insulated housing including a molded base, a molded cover and a plurality of fasteners attaching the molded cover to the molded base; the molded base may include a first arcuate recess having a first end; the molded cover may include a second arcuate recess having a second end; the steel pivot pin may have a cylindrical shape with an upper portion and a lower portion; the first arcuate recess of the molded base may engage the lower portion of the steel pivot pin; the second arcuate recess of the molded cover may engage the upper portion of the steel pivot pin; and the pivot portion of the cradle may engage the upper portion of the steel pivot pin between the first and second ends of the first and second arcuate recesses.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is disclosed in connection with a single pole, molded case, thermal/magnetic circuit breaker. However, it will be appreciated that the invention is applicable to a wide range of electrical switching apparatus, such as, for example, circuit breakers including a cradle, one or more poles, and a wide range of operating and/or trip mechanisms and housings. An example of a single pole, molded case, thermal/magnetic circuit breaker is disclosed in U.S. Pat. No. 5,805,038, which is incorporated by reference herein.

As employed herein, the terms "general U-shape" and "generally U-shaped" shall expressly include, but not be limited to, U-shapes and variations thereof, such as, for example, an arcuate portion or substantially arcuate portion attached on each end thereof to a leg portion, such as a linear, arcuate, substantially linear and/or substantially arcuate portion; a semi-circular portion or substantially semi-circular portion attached on each end thereof to a leg portion; a substantial U-shape including an arcuate portion or substantially arcuate portion attached on each end thereof to a leg portion; and a substantial V-shape including an arcuate portion or substantially arcuate portion attached on each end thereof to a leg portion.

Figure 1:
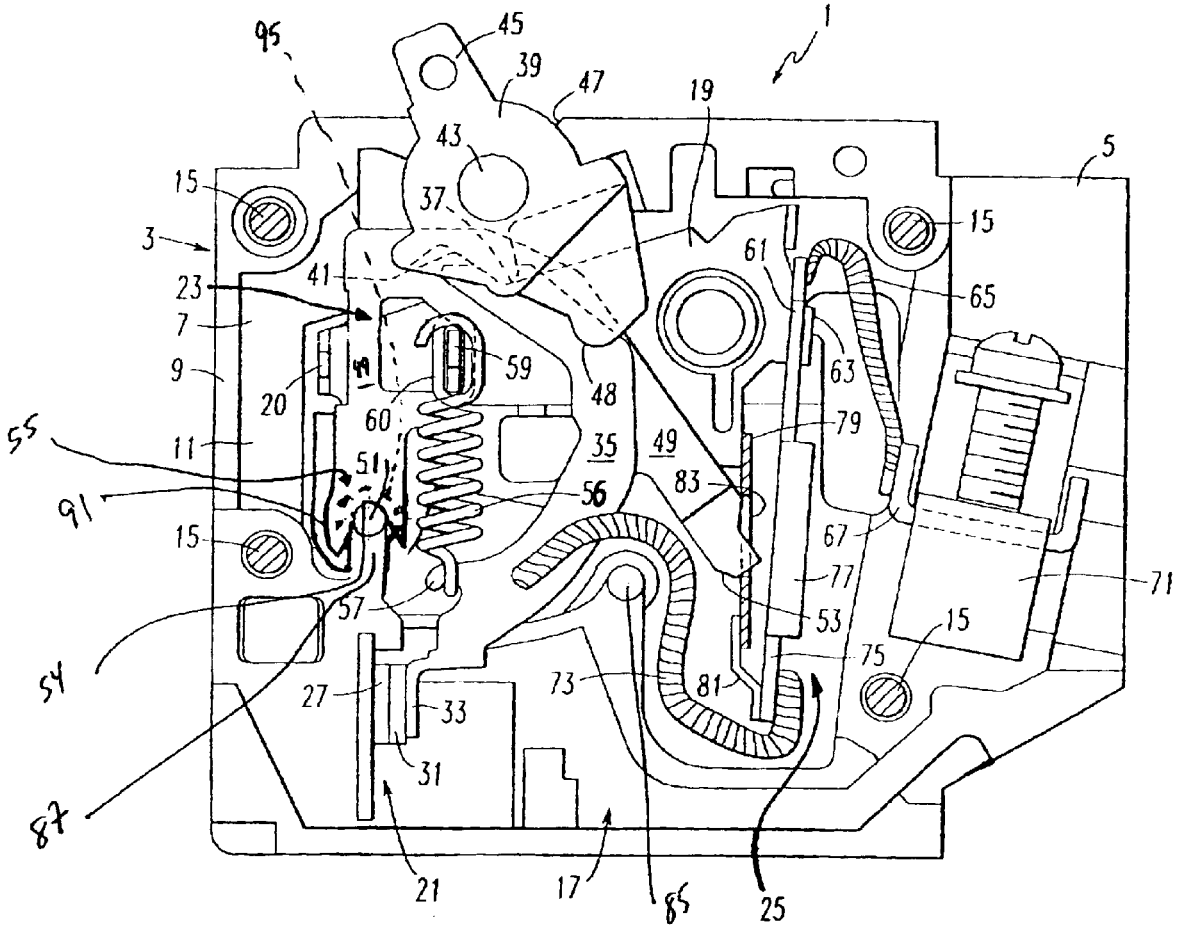
FIG. 1 is a side view of a circuit breaker in accordance with the present invention, with the cover removed and the circuit breaker shown in the ON or closed position.

Referring to FIG. 1, the circuit breaker 1 of the present invention comprises an electrically insulating housing 3 (e.g., made of UREA; glass polyester) having a molded insulating base 5 with a planar wall 7 and edge walls 9 forming a cavity 11. The housing 3 further includes a molded insulating (top) cover 4 (shown in FIGS. 3 and 6) which is secured to the base 5 by rivets 15. The housing 3 may further include a molded insulating (bottom) cover (not shown). A circuit breaker assembly, indicated generally at 17, is supported in the cavity 11 of the housing 3. The circuit breaker assembly 17 includes a support plate 19 having a stop 20, a set of electrical contacts 21, a latchable operating mechanism 23 and a trip assembly 25.

The set of electrical contacts 21 includes a stationary contact 27 secured in the housing 3 to a plug-in type line terminal (not shown), and a movable contact 31 secured to a small flange 33 on one end of a flat metallic, generally C-shaped contact arm 35, which forms part of the latchable operating mechanism 23. The contact arm 35 is provided at the upper end with a depression 37 (shown in hidden line drawing). A molded insulating operating member 39 has a molded part 41 (shown in hidden line drawing) which engages the depression 37 in the contact arm 35 to provide a driving connection between the operating member 39 and the contact arm 35. The operating member 39 is molded with a pair of pins 43 (only one pin 43 is shown), which extend outwardly on opposite sides and which fit into bearing openings (not shown) in the (bottom) cover (not shown), base 5 and (top) cover 4 of the housing 3 to support the operating member 39 for pivoted movement. The operating member 39 includes a handle part 45 which extends through an opening 47 on top of the housing 3 to enable manual operation of the circuit breaker 1. The operating member 39 also includes a downwardly extending portion 48 for engaging the latchable operating mechanism 23, in order to reset the circuit breaker 1 following tripping.

Figure 3:
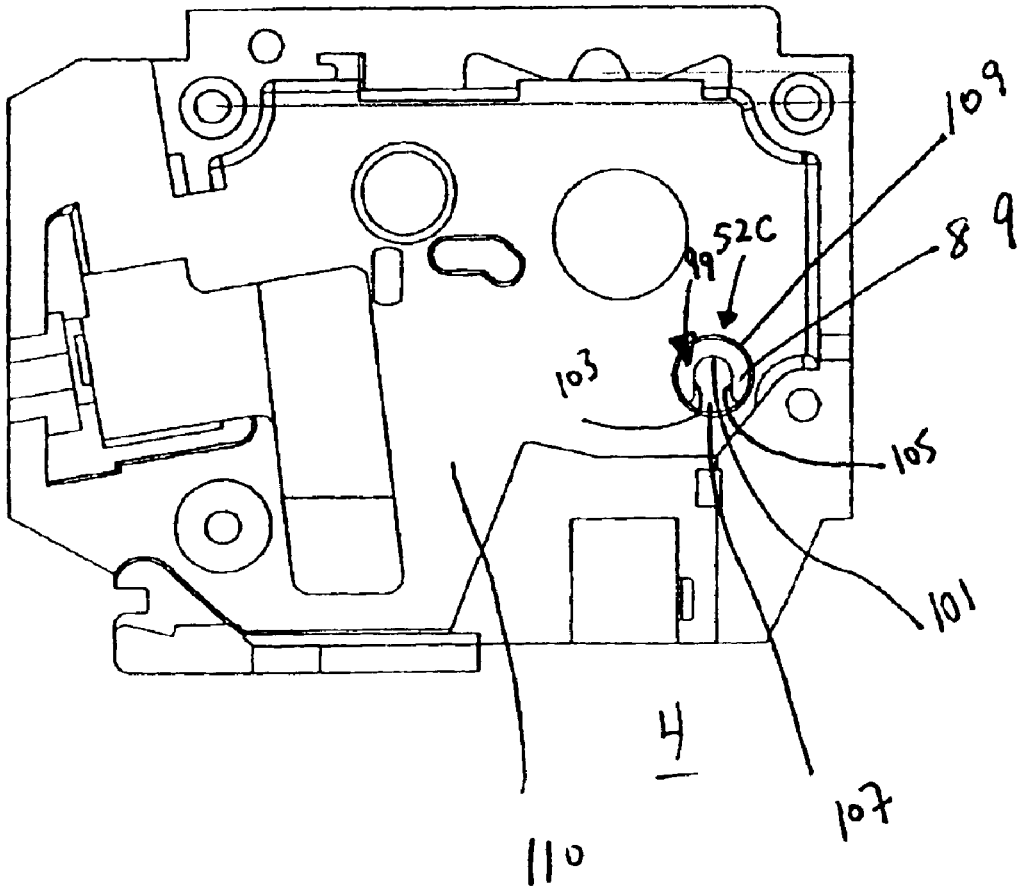
FIG. 3 is a plan view of the cover of the circuit breaker of FIG. 1.
Figure 4:
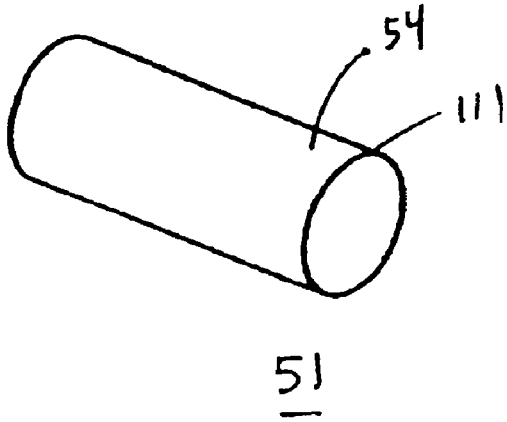
FIG. 4 is an isometric view of the cradle pivot pin of FIG. 1.

The latchable operating mechanism 23 also includes a cradle 49 supported at one end for pivoted movement on a pivot pin 51 (e.g., made of steel; stainless steel; another suitably hardened material). The pivot pin 51 is disposed in recesses 52B (FIG. 2) and 52C (FIG. 3) of the insulating housing base 5 and cover 4, respectively. The other end of the cradle 49 has a latch ledge 53, which is latched by the trip assembly 25. As shown in FIG. 4, the pivot pin 51 has a cylindrical shape with a semi-circular portion 54 for engagement with the cradle 49. As best shown in FIG. 1, the pivot end of the cradle 49 includes a pivot portion 55 having a general U-shape, which pivotally engages the semi-circular portion 54 of the pivot pin 51.

An over center tension spring 56 is connected, under tension, at one end to a projection 57 near the lower end of the contact arm 35, and at the upper end thereof to a bent over projection 59 on the cradle 49. A shock absorber 60 may be mounted to either the stop 20 or the projection 59, to absorb the shock or impact forces resulting from manual operation of the handle 45 from the ON position to the OFF position.

The trip assembly 25 comprises an elongated bimetal member 61 secured, in proximity to its upper end, to a bent over tab part 63 on the support plate 19. A flexible conductor 65 is secured at one end to the upper end of the bimetal member 61 and at the other end to a conductor 67 that extends through an opening in the housing 3 and is part of a solderless terminal connector 71 that is externally accessible and supported in the housing 3 in a well known manner. Another flexible conductor 73 is secured at one end to the free, lower end 75 of the bimetal member 61 and at the other end thereof to the contact arm 35 to electrically connect the contact arm 35 with the bimetal member 61.

The electrical circuit through the circuit breaker 1 extends from the line terminal (not shown), through the stationary contact 27, the movable contact 31, the contact arm 35, the flexible conductor 73, the bimetal member 61, the flexible conductor 65, the conductor 67, and the solderless terminal connector 71.

The trip assembly 25 includes a thermal trip capability, which responds to persistent low level overcurrents, and a magnetic trip capability, which responds instantaneously to relatively higher overload currents. The trip assembly 25 includes the bimetal member 61, a magnetic yoke 77 and a magnetic armature 79. The magnetic yoke 77 is a generally U-shaped member secured to the bimetal member 61 at a bight portion (not shown) of the magnetic yoke 77 with the legs thereof facing the armature 79. The magnetic armature 79 is secured to a supporting leaf spring 81 that is, in turn, secured at its lower end near the free end 75 of the cantilevered bimetal member 61. Thus, the armature 79 is supported on the bimetal member 61 by the leaf spring 81. The armature 79 has a window opening 83 through which the one end of the cradle 49 extends with the latch ledge 53 on the cradle engaging the edge of the window 83 to latch the latchable operating mechanism 23 in the latched position, as shown in FIG. 1.

With the circuit breaker in the ON position, a persistent overload current of a predetermined value causes the bimetal member 61 to become heated and deflect to the right (with respect to FIG. 1) to effect a time delayed thermal trip operation. The armature 79, which is supported on the bimetal member 61 by the leaf spring 81, is carried to the right with the bimetal member to release the cradle 49. When the cradle 49 is released, the spring 56 rotates the cradle clockwise (with respect to FIG. 1) on the pivot pin 51 until this motion is arrested by the engagement of the cradle with a molded part 85 of the housing base 5. During this movement, the line of action of the spring 56 moves to the right of the point at which the contact arm 35 is pivoted on the operating member 39 to rotate the contact arm counter-clockwise (with respect to FIG. 1) to separate the set of electrical contacts 21. In addition, as is well known, the operating member 39 is rotated to position the handle 45 in a position (not shown) intermediate of the ON and OFF positions to provide a visual indication that the circuit breaker 1 has tripped open.

Before the contacts 21 can be closed following an automatic trip operation, it is necessary to reset and relatch the operating mechanism 23. This is accomplished by moving the operating member 39 clockwise (with respect to FIG. 1) from the intermediate position (not shown) to a position slightly beyond a full clockwise OFF position (not shown) to relatch the cradle 49. During this movement, due to the engagement of the downwardly extending portion 48 of the operating member 39 with the projection 59 of the cradle 49, the cradle is moved counterclockwise (with respect to FIG. 1) about the pivot pin 51 until the latch ledge 53 of the cradle is again latched in the window opening 83 of the armature 79. The handle 45 may then be moved in a counterclockwise direction to the ON position (FIG. 1), which moves the upper end of the contact arm 35 to the right of the line of action of the spring 56 to snap the contacts 21 to the closed position.

The circuit breaker 1 is magnetically tripped automatically and instantaneously in response to overload currents above a second predetermined value higher than the predetermined value for the thermal trip. Flow of overload current above this higher predetermined value through the bimetal member 61 induces magnetic flux around the bimetal. This flux is concentrated by the magnetic yoke 77 toward the armature 79. Overload current above the second predetermined value generates a magnetic force of such a strength that the armature 79 is attracted toward the magnetic yoke 77 resulting in the flexing of the leaf spring 81 permitting the armature 79 to move to the right to release the cradle 49 and trip the circuit breaker 1 open in the same manner as described above with regard to a thermal trip operation. Following a magnetic trip operation, the circuit breaker 1 is reset and relatched in the same manner as described above.

In addition to the handle 45 being manually maneuverable from the OFF position to the ON position, in order to place the contacts 21 in the closed position (FIG. 1) and establish the electrical circuit through the circuit breaker 1 for normal operation as described herein, the circuit breaker 1 may also be manually operated from the ON position to the OFF position (not shown) thereby placing the contacts 21 in an open position and terminating flow through the circuit breaker 1 and interrupting the electrical circuit. More specifically, when going from the ON position to the OFF position, the handle 45 is moved in a clockwise direction (with respect to FIG. 1) from the handle ON position (FIG. 1) to the handle OFF position (not shown). Due to the tension which exists in the spring 56 to maintain the contacts 21 in the closed position, a sufficient amount of force must be applied to the handle 45, in order to overcome the tension in the spring and allow the handle to move in a clockwise direction. As the force is applied and handle 45 begins to move in the clockwise direction, the upper end of contact arm 35 also begins to move in a counterclockwise direction as a result of the driving connection provided between the molded part 41 of operating member 39 and the depression 37 of the contact arm 35. This cooperation between the molded part 41 and the depression 37 defines a pivot point about which the contact arm 35 is pivoted on the operating member 39 to rotate the contact arm.

Figure 2:
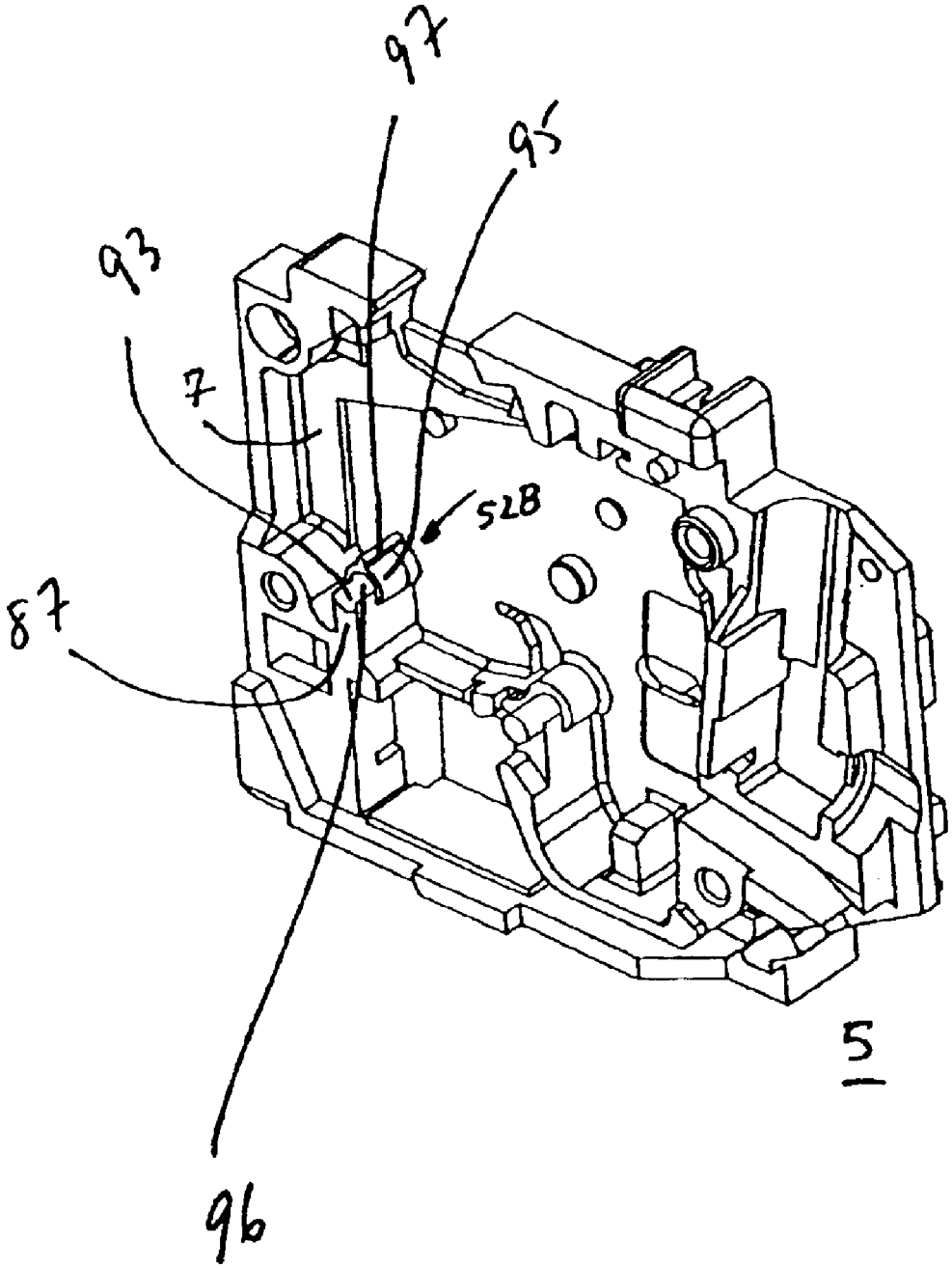
FIG. 2 is an isometric view of the base of the circuit breaker of FIG. 1.
Figure 6:
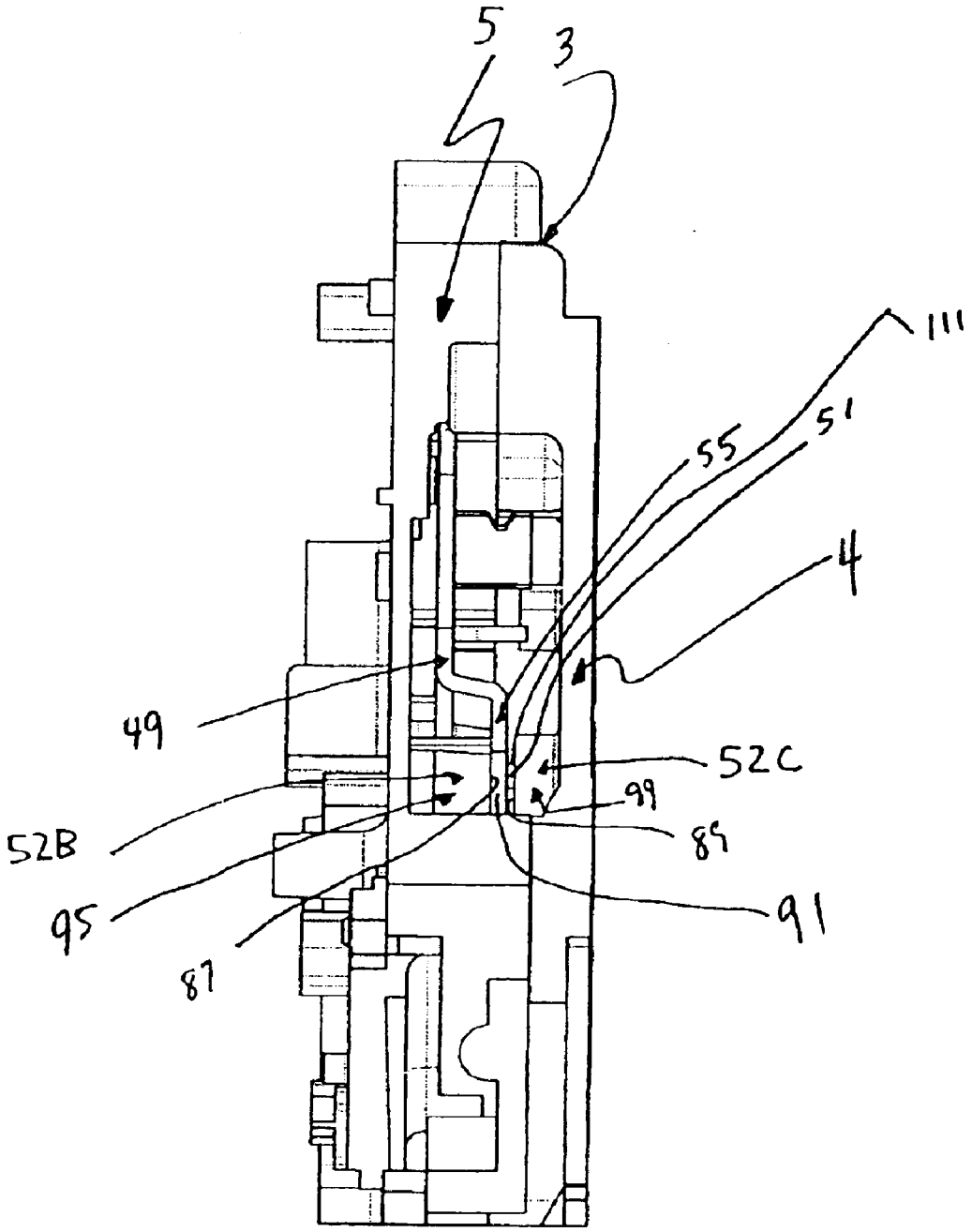
FIG. 6 is an end elevation view of the circuit breaker of FIG. 1, with a portion of the base and a portion of the cover removed to show the cradle and the cradle pivot pin.

Referring to FIG. 6, the top cover 4 and the base 5 of the housing 3 are partially cut away to show the cradle 49 and the pivot pin 51. Only a small portion of the pivot pin 51 is shown between the cradle 49 and the cover recess 52C. As best shown in FIG. 2, the arcuate recess 52B of the base 5 has an end 87. As best shown in FIG. 3, the arcuate recess 52C of the cover 4 has a general U-shape and an end 89. The base arcuate recess 52B engages the lower portion of the pivot pin 51 and the cover arcuate recess 52C engages the upper portion of the pivot pin 51. The generally U-shaped cradle pivot portion 55 (as best shown in FIG. 1) engages the upper portion of the pivot pin 51 between the ends 87,89 of the respective U-shaped recesses 52B,52C. For reference in FIG. 6, an arcuate portion 91 of the cradle pivot portion 55 is shown in FIGS. 1 and 6.

Figure 5:
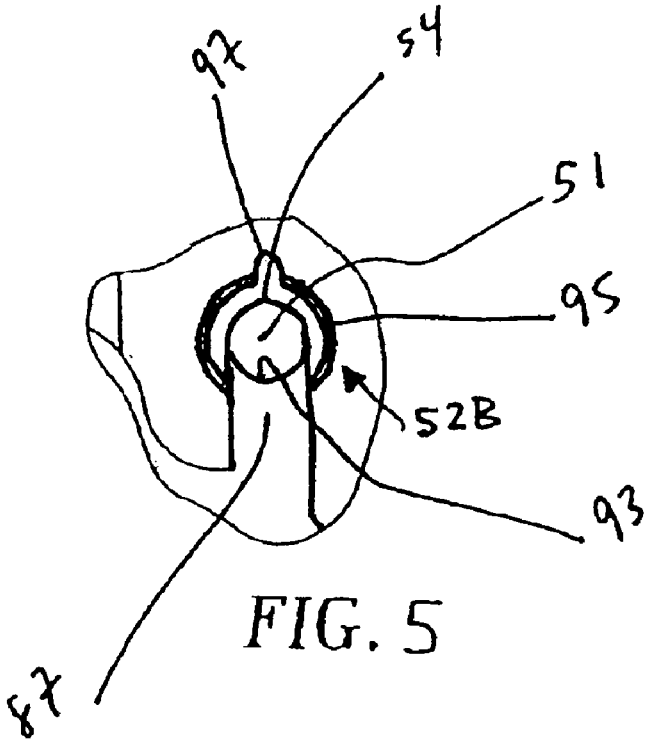
FIG. 5 is a plan view of the arcuate recess portion of the base and the cradle pivot pin of FIG. 1.

As shown in FIG. 2 and 5, the base recess 52B is formed from a first semi-circular portion 93, which supports the pivot pin 51. A second semi-circular portion 95 (shown in hidden line drawing in FIG. 1) of the base 5 has a smaller height above the base planar wall 7 than the corresponding height of the first semi-circular portion 93 and partially surrounds the same. The first semi-circular portion 93 engages the lower portion of the pivot pin 51 of FIG. 5. The pin 51 extends into a recess portion 96 (FIG. 2) defined by the semi-circular portions 93,95. A flange portion 97 of the second semi-circular portion 95 reinforces the same with respect to the base 5.

As shown in FIG. 3, the cover U-shaped recess 52C is formed from a U-shaped portion 99 having a semi-circular portion 101, two legs 103,105 and an open portion 107. A circular portion 109 of the cover 4 encircles the U-shaped portion 99, has a smaller height above the cover planar wall 110 than the corresponding height of the U-shaped portion 99, and reinforces the same. The semi-circular portion 101 engages the upper portion 111 of the pivot pin 51 of FIGS. 4 and 6.

Using the exemplary steel pivot pin 51 permits the housing 3 to be made, for example, from glass polyester material, which is relatively easier, more cost effective to mold and stronger than UREA. Furthermore, glass polyester material has a relatively higher recovery than UREA when circuit breaker repair is required. Also, the steel pivot pin 51 wears considerably less than a molded pivot pin, thereby improving reliable long-term operation of the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing including a recess, said housing being made of a first material;

a pivot pin disposed in the recess of said housing, said pivot pin being made of a second material, which is substantially harder than said first material;

separable contacts disposed within said housing;

an operating mechanism disposed within said housing for moving said separable contacts between an open position and a closed position, said operating mechanism including a cradle having a pivot portion which pivotally engages said pivot pin; and wherein said housing further includes a base and a cover attached to said base; wherein said base includes a first arcuate recess; wherein said cover includes a second arcuate recess; wherein said pivot pin has a cylindrical shape with a first portion and a second portion; wherein one of said first and second arcuate recesses engages the first portion of said pivot pin; and wherein another one of said first and second arcuate recesses engages the second portion of said pivot pin.

2. A circuit breaker comprising:

a housing including a recess, said housing being made of a first material;

a pivot pin disposed in the recess of said housing, said pivot pin being made of a second material, which is substantially harder than said first material;

separable contacts disposed within said housing;

an operating mechanism disposed within said housing for moving said separable contacts between an open position and a closed positions, said operating mechanism including a cradle having a pivot portion which pivotally engages said pivot pin; and wherein said housing further includes a base, a cover and a plurality of fasteners attaching said cover to said base; wherein said base includes a first arcuate recess having a first end; wherein said cover includes a second arcuate recess having a second end, wherein said pivot pin has a cylindrical shape with a first portion and a second portion; wherein one of said first and second arcuate recesses engages the first portion of said pivot pin; wherein another one of said first and second arcuate recesses engages the second portion of said pivot pin; and wherein the pivot portion of said cradle engages said pivot pin between the first and second ends of said first and second arcuate recesses.

3. A circuit breaker comprising:

a housing including a recess;

a steel pivot pin disposed in the recess of said housing;

separable contacts disposed within said housing;

an operating mechanism disposed within said housing for moving said separable contacts between an open position and a closed position, said operating mechanism including a cradle having a latch portion and a pivot portion which pivotally engages said steel pivot pin;

a trip mechanism cooperating with said operating mechanism to trip open said separable contacts, said trip mechanism including a portion which engages the latch portion of said cradle when said separable contacts are in the closed position; and wherein said housing is a molded insulated housing including a molded base, a molded cover and a plurality of fasteners attaching said molded cover to said molded base; wherein said molded base includes a first arcuate recess having a first end; wherein said molded cover includes a second arcuate recess having a second end; wherein said steel pivot pin has a cylindrical shape with sit upper portion and a lower portion; wherein the first arcuate recess of said molded base engages the lower portion of said steel pivot pin; wherein the second arcuate recess of said molded cover engages the upper portion of said steel pivot pin; and wherein the pivot portion of said cradle engages the upper portion of said steel pivot pan between the first and second ends of said first and second arcuate recess.

* * * * *